US005441286A

United States Patent [19]

Pozzobon

[11] Patent Number: 5,441,286

[45] Date of Patent: Aug. 15, 1995

[54] WHEEL MOUNTING DEVICE FOR INLINE SKATES

[75] Inventor: Alessandro Pozzobon, Paderno Di Ponzano Veneto, Italy

[73] Assignee: Nordica S.p.A., Trevignano, Italy

[21] Appl. No.: 168,596

[22] Filed: Dec. 14, 1993

[30] Foreign Application Priority Data

Dec. 22, 1992 [IT] Italy ..... TV92A0159

[51] Int. Cl.[6] ..... A63G 17/00

[52] U.S. Cl. ..... 280/1127; 280/11.22; 280/11.28; 301/5.3; 301/111

[58] Field of Search ..... 280/11.19, 11.22, 11.23, 280/11.27, 11.28; 301/5.3, 5.7, 111, 124.2

[56] References Cited

U.S. PATENT DOCUMENTS

| | | | |
|---|---|---|---|
| 4,666,169 | 5/1987 | Hamill et al. | 280/11.23 |
| 5,068,956 | 12/1991 | Malewicz | 280/11.27 |
| 5,312,120 | 5/1994 | Wiegner | 280/11.27 |
| 5,356,209 | 10/1994 | Hill | 301/5.7 |

FOREIGN PATENT DOCUMENTS

| | | | |
|---|---|---|---|
| 0503877 | 9/1992 | European Pat. Off. . | |
| 207067 | 2/1909 | Germany | 301/124.2 |
| 4783 | 12/1876 | Italy | 280/11.27 |
| 461929 | 9/1951 | Italy | 301/124.2 |

*Primary Examiner*—Richard M. Camby
*Assistant Examiner*—Min S. Yu
*Attorney, Agent, or Firm*—Guido Modiano; Albert Josif

[57] ABSTRACT

A device for mounting wheels and for compensating plays, particularly usable in skates including a shoe associated with a supporting frame for one or more possibly mutually aligned wheels composed of a central hub with which an annular element, acting as tire, is associated. The device is constituted by a pivot which is associatable with the hub and the frame and has, at its ends, an engagement-disengagement lever and a play compensation member.

5 Claims, 1 Drawing Sheet

WHEEL MOUNTING DEVICE FOR INLINE SKATES

BACKGROUND OF THE INVENTION

The present invention relates to a device for mounting wheels, particularly for roller skates, and also for compensating plays.

Conventional roller skates are usually constituted by a shoe having a sole associated with a substantially U-shaped frame; one or more possibly mutually aligned wheels are pivoted between the wings of the frame by means of an adapted pivot.

A problem that arises in these conventional skates is the fact that rapid wear of the wheels entails their frequent replacement.

Such replacement is not always easy because it requires particular tools such as for example screwdrivers or wrenches.

As a solution to this drawback, devices have been designed which allow the quick disengagement and reengagement of the wheels without requiring the user to use particular tools.

However, due to frequent replacements, as well as to the presence of possible machining tolerances, in conventional skates there is always a certain play between the hub of the wheel, the frame and the pivot, and this increases the wear of the various parts due to the consequent friction, which also limits the maximum speed attainable with the skate.

SUMMARY OF THE INVENTION

The aim of the present invention is to eliminate the described technical problems, solving the drawbacks described above in conventional skates by providing a device which allows rapid and optimum compensation of plays between the wheels and the components of the skate.

Within the scope of the above aim, an important object is to provide a device which allows to compensate plays even when the wear of the various components varies.

Another important object is to provide a device in which plays can be compensated rapidly and easily by the user.

Another important object is to provide a device which is structurally simple and easy to industrialize.

Another object is to provide a device which associates with the preceding characteristics that of being reliable and safe in use and has low manufacturing costs.

This aim, these objects and others which will become apparent hereinafter are achieved by a wheel mounting device, particularly for skates which comprise a shoe associated with a supporting frame for a plurality of wheels composed of a central hub with which a substantially annular element is associated, said annular element acting as tire, characterized in that it comprises a pivot which is associatable with said hub and said frame with the interposition of at least one spacer, said pivot being provided with a first and a second end with which means for the temporary locking of said pivot to said frame and means for compensating plays are associated.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3, 4, 5, 6:
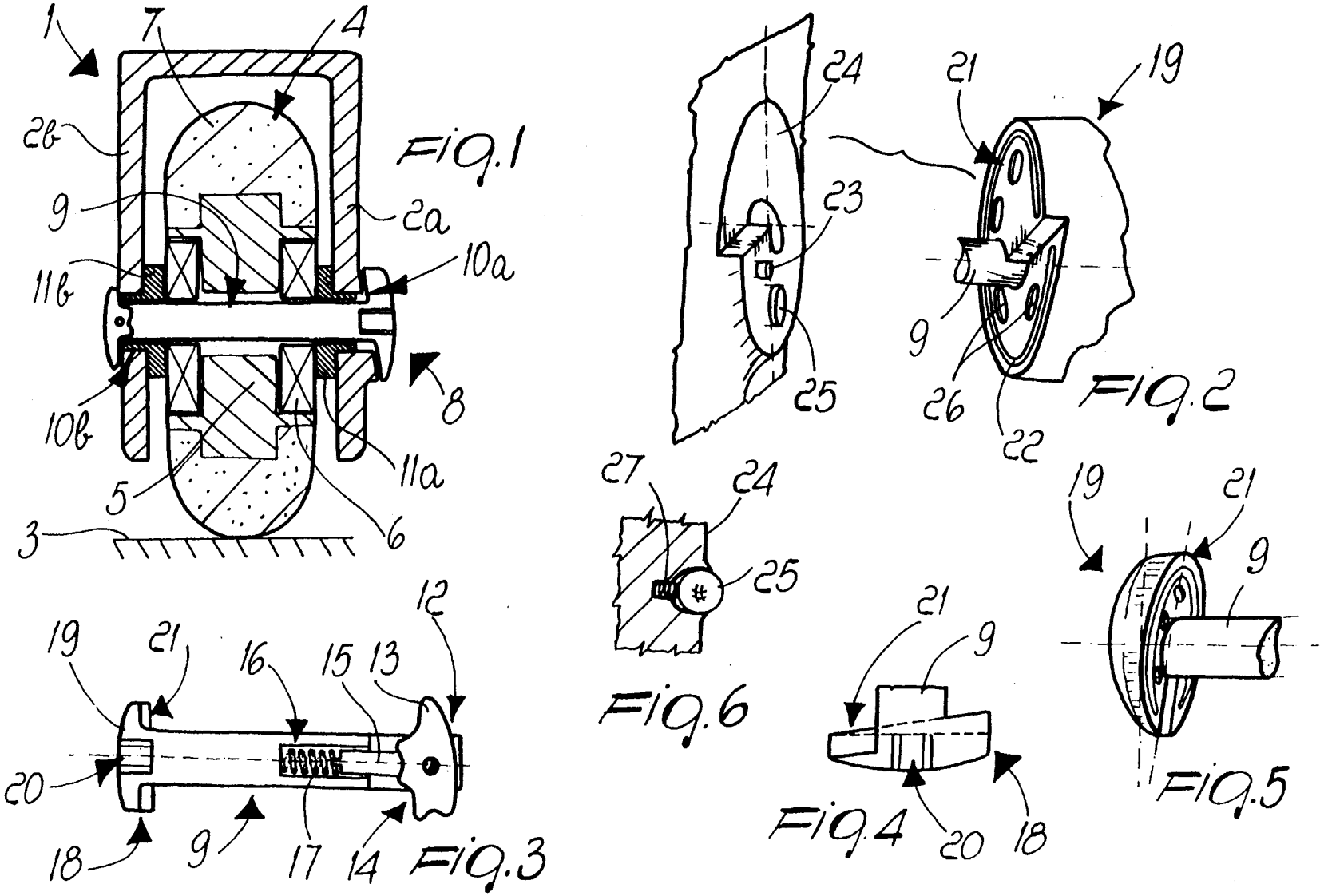
FIG. 1 is a cross section view of the device, taken at the supporting frame of a skate with aligned wheels.
FIG. 2 is a partially cutout perspective view of the play compensating means of the device.
FIG. 3 is a partially sectional view of the pivot of the device.
FIG. 4 is a side view of one end of the pivot of FIG. 3.
FIG. 5 is a perspective bottom view of the end of the pivot shown in FIG. 4.
FIG. 6 is a sectional view of a different embodiment of the means which allow to select a given angular position.

With reference to the above figures, the reference numeral 1 designates the frame of a skate which has a substantially U-shaped cross-section in which the wings 2*a* and 2*b* are directed toward the ground 3.

The reference numeral 4 designates a wheel which comprises a central hub 5 provided with bearings 6 and with which a substantially annular element 7, acting as tire, is associated.

The device, generally designated by the reference numeral 8, comprises a pivot. 9 which is axially associated with the central hub 5 and at adapted holes 10*a* and 10*b* formed on the wings 2*a* and 2*b* of the frame 1.

Advantageously, an adapted pair of spacers, designated by the reference numerals 11*a* and 11*b*, is located between the central hub 5 and the wings 2*a* and 2*b*. The spacers can be independent components or can be obtained monolithically from the hub or can be a combination of the two.

At a first end 12, the pivot 9 has means for temporary locking to the frame 1. This means is constituted, for example, by a lever 13 which is pivoted transversely to the pivot 9 and has a lateral surface 14. Adapted cams, arranged approximately at 90° to each other, are formed on the surface 14. The cams interact with the end of a cylinder 15 which can slide axially within an adapted seat 16 formed in said pivot 9 in contrast with an elastically deformable element such as a spring 17.

The rotation of the lever 13 thus allows it to arrange itself in two distinct and stable positions: one transversely to said pivot and one axially to it, with the consequent possibility of quick extraction from the hub 5; the described means thus allow quick engagement and disengagement of the wheel 4.

As an alternative, it is possible to provide a conventional solution with a temporary locking bolt.

The pivot 9 has a second substantially T-shaped end 18 on the head 19 whereof there are a seat 20 for an actuation element, for example an Allen wrench, and, at the surface which faces the wings of the frame, a first inclined plane 21 forming a helical surface.

A guiding slot 22 for a lug 23 is formed at said first inclined plane 21. The lug protrudes from a second inclined plane 24 which forms a helical surface which is complementary to the first inclined plane 21 and is formed on the lateral surface of one of the wings 2*a* and 2*b* coaxially to the holes 10*a* and 10*b*.

Placement of the lug 23 within the slot 22 allows to guide and provides a stroke limit for the rotation of the head 19 of the pivot 9 in one direction or the other with respect to the wings of the frame through approximately 360°.

This rotation entails an axial movement of the pivot once the lever 13 has been rotated until it is arranged transversely to the pivot 9 and the wheel has thus been associated with the frame 1, with consequent play compensation.

The device also comprises a means suitable to allow to select the angular position of the head 19 with respect to the second inclined plane 24. This means is constituted by at least one protrusion 25 which protrudes from the second inclined plane 24 and fits selectively within one of a plurality of second complementarily shaped seats 26 formed on the lateral surface of the first inclined plane 21.

This accordingly allows to keep the head of the pivot in the optimum position, so as to keep the set play constant.

As an alternative, the means that allows to select the angular position of the head is constituted by a protrusion or ball 25 which is accommodated in an adapted seat formed on the second inclined plane 24 and slightly protrudes from it in contrast with an elastically deformable means 27.

It has thus been observed that the device according to the invention has achieved the above mentioned aim and objects, a device particularly for roller skates having been obtained which allows rapid and optimum compensation of plays between the wheels and the components of the skate.

The device furthermore allows to compensate plays even as the wear of the various components varies.

Play compensation furthermore occurs very rapidly, easily and comfortably for the user.

The device is naturally susceptible to numerous modifications and variations, all of which are within the scope of the same inventive concept.

The materials and the dimensions which constitute the individual components of the device may naturally be the most pertinent according to the specific requirements.

I claim:

1. In a skate comprising a shoe associated with a supporting frame (1) for a plurality of wheels, each composed of a central hub (5), and a substantially annular tire element (7) associated with said central hub, said frame having wings **(2*a*, 2*b*) directed toward the ground, said wings (2*a*, 2*b*) each having a lateral surface, a wheel mounting device (8)** comprising;

at least one spacer **(11*a*, 11*b*)**;

a pivot (8) having a first end (12) and a second T-shaped end (18), said pivot (8) being associatable with said hub (5) and said frame (1) with the interposition of said at least one spacer **(11*a*, 11*b*)**;

means (13, 14, 15, 17) for at least temporarily locking said pivot to said frame (1), said means being connected to said first end (12);

a head (19) defined by said T-shaped second end (18);

a seat (20) defined in said head (19) for accommodating an actuation element for rotating said second T-shaped end (18) of said pivot (8) with respect to said wings **(2*a*, 2*b*) of said supporting frame (1)**;

a first inclined plane (21) defined by said head (19), said first inclined plane (21) forming a helical surface and facing at least one of said wings **(2*a*, 2*b*)** and;

a second inclined plane (24) formed on said lateral surface of at least one of said wings **(2*a*, 2*b*), said second inclined plane defining a helical surface which is complementary to said first inclined plane (21)**.

2. Wheel mounting device according to claim 1, wherein said first inclined plane (21) has a guiding slot (22), said second inclined plane (24) has a lug (23) protruding from said plane (24), said lug (23) engaging said guiding slot (22), wherein said head (19) of said pivot (9) is rotatable through an angle of approximately 360 degrees in either direction with respect to said wings **(2*a*, 2*b*) of said frame (1), said lug (23) slideably engaging said guiding slot (22) whereby to provide a stroke limit for said rotation of said head (19)**.

3. Wheel mounting device according to claim 2, wherein said rotation of said head (19) with respect to said wings **(2*a*, 2*b*) causes, upon actuation of said temporary locking means (13), an axial movement of said pivot (9)** with consequent play compensation.

4. Wheel mounting device according to claim 2, comprising means for selecting an angular rotation of said head (19) with respect to said second inclined plane (24), said means being constituted by;

at least one protrusion (25) protruding from said second inclined plane (24) and;

a plurality of second complementarily shaped seats (26) formed laterally on said first inclined plane (21) wherein said protrusion (25) is selectively engageable in one of said complementarily shaped seats **(26*a*)**.

5. Wheel mounting device (8) according to claim 2, comprising means for selecting an angular rotation of said head (19) with respect to said second inclined plane (24), said means being constituted by a plurality of second complementarily shaped seats (26) formed laterally on said first inclined plane (21), and;

at least one protrusion (25) protruding from said second inclined plane (24), said protrusion (25) being accommodated in an adapted seat formed on said second inclined plane (24) and slightly protruding from said second inclined plane in contrast with an elastically deformable means (27), wherein said protrusion is constituted by a ball (25).

* * * * *